United States Patent [19]

Suzuki

[11] Patent Number: 4,682,875

[45] Date of Patent: Jul. 28, 1987

[54] IMAGE FORMING SYSTEM HAVING EXTERNAL SIGNAL GENERATING MEANS

[75] Inventor: Tadashi Suzuki, Yokohama, Japan

[73] Assignee: Canon Kabushiki Kaisha, Tokyo, Japan

[21] Appl. No.: 814,685

[22] Filed: Dec. 30, 1985

[30] Foreign Application Priority Data

Jul. 21, 1982 [JP] Japan ..... 57-125721
Jul. 21, 1982 [JP] Japan ..... 57-125722

[51] Int. Cl.[4] ..... G03G 15/00
[52] U.S. Cl. ..... 355/3 R; 355/14 R
[58] Field of Search ..... 355/3 R, 14 R, 14 C; 340/825.36, 825.54, 825.55; 358/256–258, 296

[56] References Cited

U.S. PATENT DOCUMENTS 3,281,789 10/1966 Willcox et al. ..... 340/825.55 X
3,694,811 9/1972 Wood ..... 340/825.54
4,167,322 11/1979 Yano et al. ..... 355/3 R
4,375,329 3/1983 Park ..... 355/14 C

FOREIGN PATENT DOCUMENTS 54-73638 6/1979 Japan ..... 355/3 R
55-90962 7/1980 Japan ..... 355/14 R
56-27161 3/1981 Japan ..... 355/14 C
57-78563 5/1982 Japan ..... 355/14 R
57-99657 6/1982 Japan ..... 355/14 R

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image forming system comprises an image forming apparatus, a plurality of signal generators for issuing inquiry signals to the image forming apparatus, and a device for receiving the inquiry signal from the signal generator and transmitting a signal indicating a state of the image forming apparatus to the inquiring signal generator.

4 Claims, 9 Drawing Figures

IMAGE FORMING SYSTEM HAVING EXTERNAL SIGNAL GENERATING MEANS

This is a continuation of application Ser No. 514,599, filed July 18, 1983, now abandoned.

BACKGROUND OF THE INVENTION

1. Field of the Invention

The present invention relates to an image forming apparatus such as a copying machine, and more particularly to a system for transmitting information to an external equipment of the image forming apparatus.

2. Description of the Prior Art

In a prior art copying machine, a user is informed of operation procedures of the machine or operation states of the machine through display means in a control panel. Displays by patterns are designed to inform the user visually and they are effective information transmission means to an unexperienced user. However, when more information items are to be represented by displays, the display designs must be complex or the effect of displays may not be fully attained if the user does not pay attention to the displays or leaves the site of the copying machine during a continuous copy operation. Accordingly, in order to call a user's attention or as a guidance to inform an end of wait time of the copying machine to persons around the copying machine, it is effective to provide an audio announcing means by speech synthesization as the information transmitting means. However, in an office in which the copying machine is usually in use, a frequent audio announcement may be a disturbing noise source to persons other than the user of the copying machine. It also may be one-way information from the copying machine to a distant person.

SUMMARY OF THE INVENTION

It is an object of the present invention to provide an image forming apparatus or a console terminal which enables a user to grasp operating states of the image forming apparatus and control the image forming apparatus at a distant place therefrom without making noise.

It is another object of the present invention to provide an image forming apparatus or system which can transmit information from the image forming apparatus to a selected area or a selected person.

It is other object of the present invention to provide an image forming apparatus or system which can selectively transmit information as limited information or non-limited information depending on the nature of the information.

It is a further object of the present invention to provide an image forming apparatus or system which can keep an office quite and improve efficiency and manageability.

It is a still further object of the present invention to provide an image forming apparatus or system which can acquire necessary information through inquiry to a host unit.

The above and other objects of the present invention will be apparent from the following description of the invention.

DETAILED DESCRIPTION OF THE PREFERRED EMBODIMENTS

Figure 1:
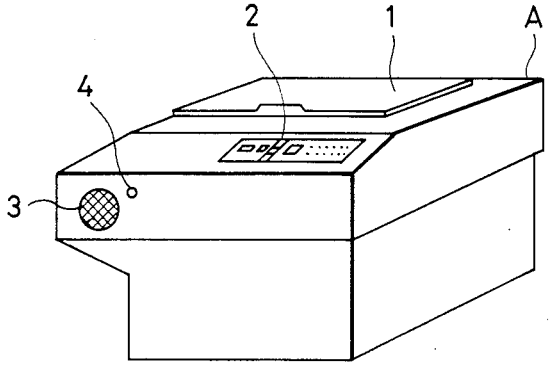
FIG. 1 is an external perspective view of one embodiment of a copying machine of the present invention.

FIG. 1 shows an external perspective view of one embodiment of the copying machine. In FIG. 1, A denotes a main unit of the copying machine, numeral 1 denotes an original mount on which an original is mounted, numeral 2 denotes a control panel having control keys and displays, numeral 3 denotes a speaker for generating a synthesized speech sound, and numeral 4 denotes a high frequency microphone for transmitting and receiving a high frequency signal in a non-audio range. The copying machine A contains an electrographic copying mechanism (not shown).

Figure 2:
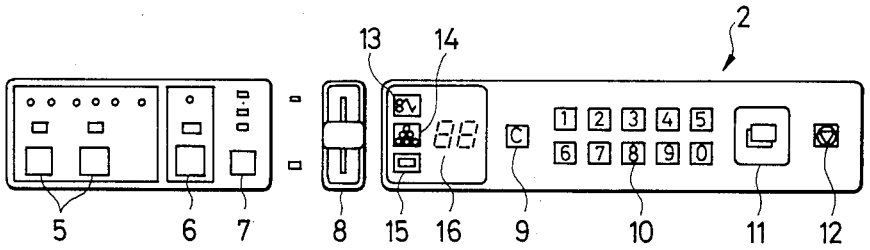
FIG. 2 is a top view of a control panel.

FIG. 2 shows a plan view of the control panel 2. Numeral 5 denotes reduction keys, numeral 6 denotes an enlargement key, and numeral 7 denotes an equiscale key. One of those keys is depressed depending on a desired magnification factor. Numeral 8 denotes a copy density adjusting lever for controlling a density of a copy, numeral 9 denotes a clear key for updating a preset count of copies, numeral 10 denote a ten-key for presetting a count of copies, numeral 11 denotes a start key for starting a copy operation, and numeral 12 denotes a stop key for interrupting the copy operation during a continuous copy operation. Hereinafter, the operation from the depression of the start key 11 to the completion of the copies preset by the ten-key 10 is referred to as a copy mode. Numeral 13 denotes an indicator which is lit when a paper feed is abnormal, numeral 14 denotes an indicator which is lit when toner is to be supplemented, numeral 15 denotes an indicator which is lit when copy papers are to be supplemented, and numeral 16 denotes a numeric display which displays the copy count or numerically displays abnormal conditions of the copying machine A. Hereinafter, the displays displayed by 13–16 are referred to as trouble displays. The information displayed on the control panel 2 is associated with sensors (not shown) mounted internally and externally of the copying machine A to sense the stataes and the operations of the machine. They may be a jam sensor for sensing the abnormal condition of the paper feed, a toner sensor for sensing the presence or absence of the toner and a form sensor for sensing the presence or absence of the copy papers.

Figure 3:
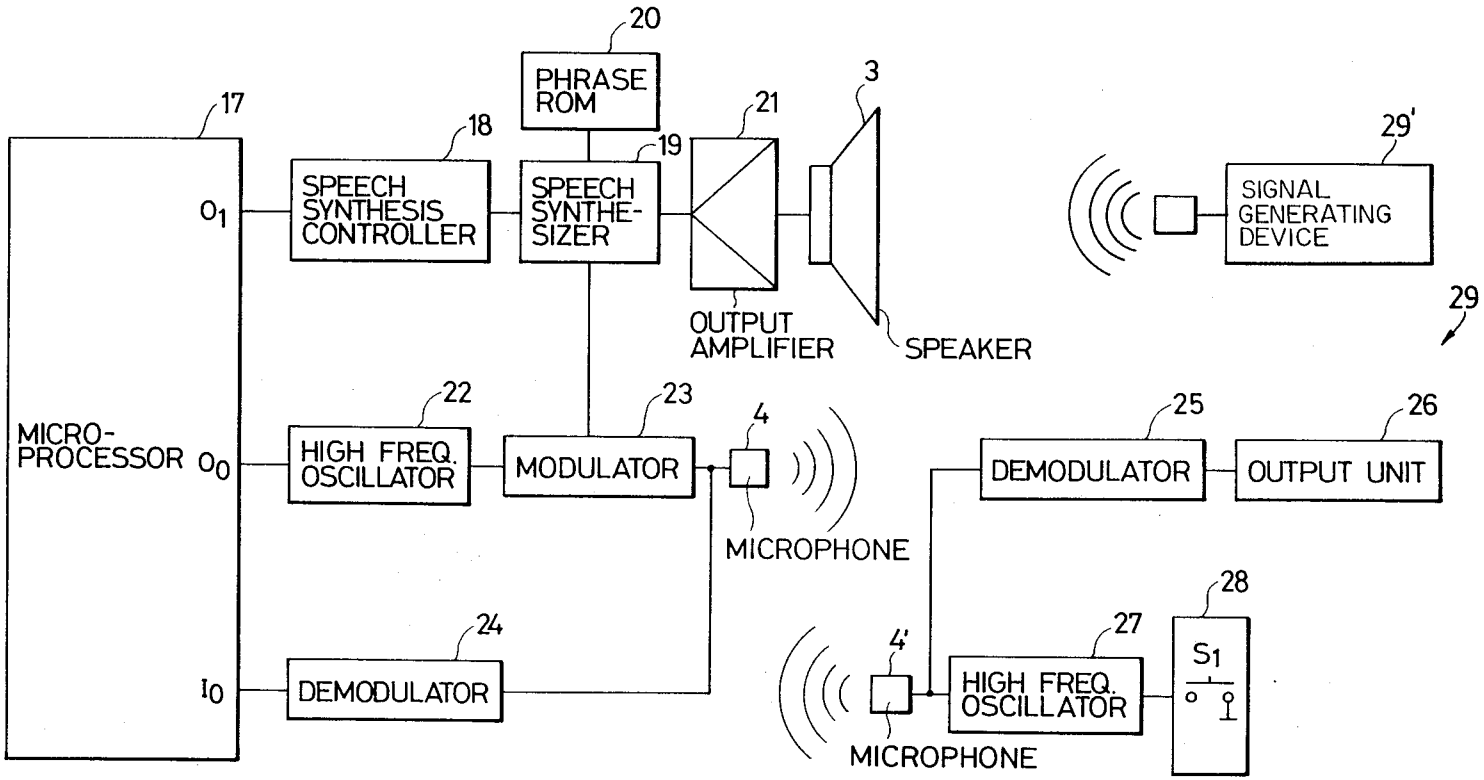
FIG. 3 is a block diagram of one embodiment of information transmitting means.

FIG. 3 shows a block diagram of speech announcing means and bilateral information transmitting means which uses a high frequency signal in a non-audio range. In FIG. 3, numeral 17 denotes a microprocessor which controls a copy sequence of the copying machine and information transmission. The speech announcing means is one of the peripheral devices connected to the microprocessor 17 and comprises a speech synthesis controller 18, a speech synthesizer 19 a phrase ROM 20, an output amplifier 21 and a speaker 3.

One of the bilateral information transmitting means which use the high frequency signal is a peripheral device connected to the microprocessor 17 and comprises a variable high frequency oscillator 22, a modulator 23, a transmitting/receiving microphone 4 and a demodulator 24 for outputting a digital code to a high frequency received signal of a predetermined frequency to the microprocessor 17. The modulator 23 amplitude-modulates a carrier of a predetermined frequency from the oscillator 22 with an audio signal from the speech synthesizer 19. The modulation is controlled by the speech synthesis controller 18 from the microprocessor 17. The amplitude modulation is used to announce a speech message to a specific area distant from the copying machine A.

The other of the bilateral information transmitting means is accommodated in independent equipment 29' external of the copying machine A. In equipment 29, for example, numeral 4' denotes a transmitting/receiving microphone, numeral 25 denotes a demodulator, and numeral 27 is a high frequency oscillator of a predetermined frequency. An output unit 26 connected to the demodulator 25 may be of any form depending on a manner of utilization of the external equipment. It may turn on a light in response to the reception of the high frequency signal of the predetermined frequency. Numeral 28 denotes an input unit. When a push button switch S1 thereof is depressed, the oscillator 28 oscillates at the predetermined high frequency. The oscillator 27 produces an output of a frequency corresponding to an input item from the input unit 28 and the microphone 4' outputs the predetermined frequency signal, thus constituting a signal generating device. This signal is received by the microphone 4 mounted in the copying machine and demodulated by the demodulator 24 to the corresponding digital code, which is then supplied to the microprocessor 17. The microprocessor 17 controls the copying machine, for example, determines the operating state of the copying machine (copy mode, trouble mode, wait-up standby mode, etc.) or sets a specific operation state in accordance with the digital code from the demodulator 24 and a decision routine and a power-up routine stored in the microcomputer 17. In accordance with an event determined by the microprocessor 17, the speech announcement is outputted from the speaker or the high frequency signal is outputted from the microphone 4 to the periphery of the copying machine.

By providing a plurality of such external equipments, such as 29 and 29' and allotting different predetermined frequencies to them, thus providing a plurality of signal generating devices, the copying machine A can selectively communicate with the plurality of external equipments 29, 29'. While FIG. 3 shows a one-channel transmitting/receiving external equipment in block diagram, a plural channel external equipment or a transmission-only or reception-only external equipment may be used. Further, the external equipment may comprise an audio detector to detect and amplify the amplitude-modulated signal modulated with the synthesized speech signal to produce the output from the speaker.

An embodiment for transmitting the information between the copying machine and the external equipment is explained as follows.

In an abnormal or alarm event occurs during the operation of the copying machine, the output signals from the sensors disposed at various points of the copying machine are supplied to the microprocessor 17. The microprocessor 17 causes the content of the event to be displayed by the corresponding display and determines if the event is to be alarmed by sound to the periphery or to be transmitted to only a specific receiving person. For example, the end of wait period of the copying machine is transmitted to the entire area of the office by sound and the abnormal copy state or the end of copy operation is transmitted to only the user distant from the copying machine. A fatal abnormal state of the copying machine may be informed to only a managing operator (service center) of the copying machine.

If the microprocessor 17 determines the need for a speech announcement, it activates the speech synthesis controller 18 which speech-synthesizes a sentence stored in the phrase ROM 20 in quantized form to produce a speech information from the speaker 3.

If the microprocessor 17 determines the need for the limited announcement, it selects the predetermined frequency of the corresponding external equipment and activates the high frequency oscillator 22 to transmit the high frequency signal through the transmitting-/receiving microphone 4. The corresponding external equipment detects by the modulator 25 that the received signal belongs to its own channel and activates the output unit 26 to inform the event to the person in the specific area.

Figure 4:
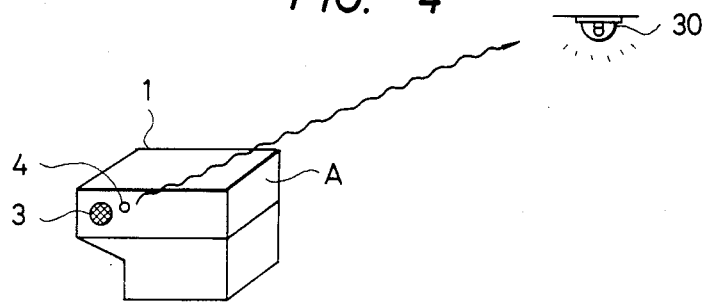
FIG. 4 shows an embodiment in which an alarm lamp is installed on a ceiling.
Figure 5:
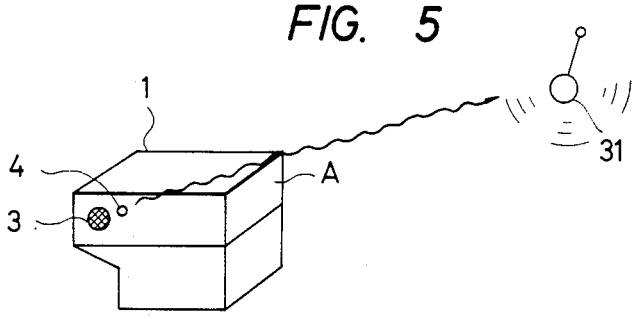
FIG. 5 shows an embodiment which uses a personal portable alarm sound generator.
Figure 6:
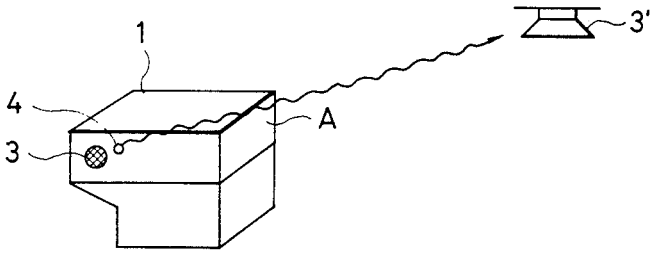
FIG. 6 shows an embodiment of remote speech announcement.

The output unit 26 may be one of various forms. For example, it may be an alarm lamp 30 mounted on a ceiling as shown in FIG. 4 or a personal portable alarm sound generator 31 as shown in FIG. 5. When the received signal is amplitude-modulated with the synthesized speech signal, a speaker 3' may be arranged in the external equipment including a detector to produce a speech output (FIG. 6). The information transmitting medium may be an infrared ray or an electromagnetic wave. Wireless transmission is advantageous for information transmission to a stationary object such as the copying machine.

Figure 9:
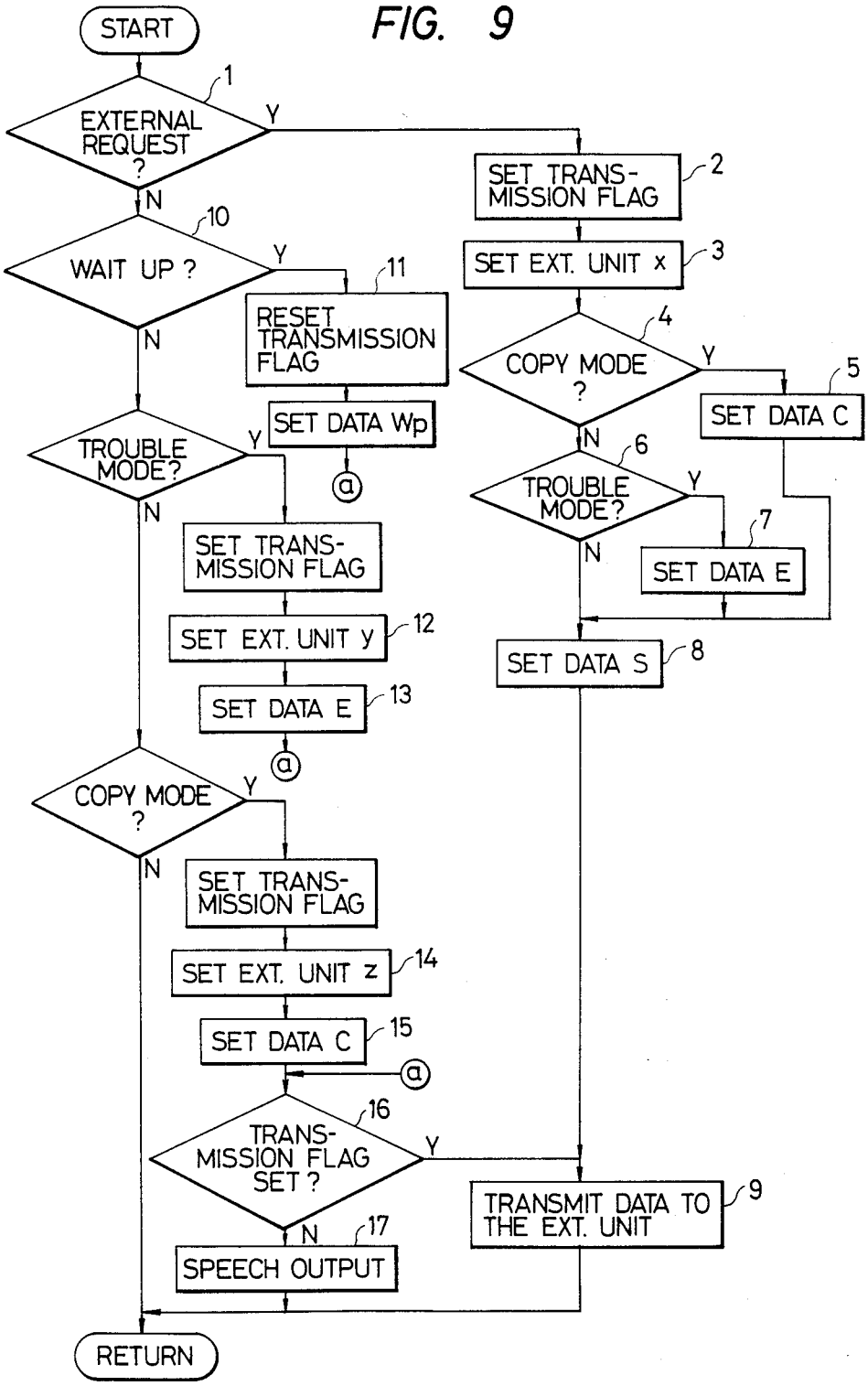
FIG. 9 is an information transmission flow chart.

FIG. 9 shows a control flow chart of the microprocessor 17. When the copying machine A is powered on, an input port Io is sensed to check the presence or absence of an external request (step 1). If the request is present, a transmission flag is set to a memory in the processor 17 (step 2) and a source of the request is determined and a destination X is set (step 3). The oscillator 22 is set to the frequency corresponding to the destination. Then, the processor 17 checks if the copying machine A is in the copy mode (step 4), and if it is in the copy mode it sets a data C (step 5), and checks if the copying machine A is in the trouble mode (step 6), and if it is in the trouble mode, it sets a data E (step 7), and if the copying macine is neither in the copy mode nor in the trouble mode, it sets a data S indicating a copy accepted (step 8). Then, the data is sent to the destination (step 9). The receiving unit displays "COPY MODE", "TROUBLE" or "COPY OK" by a liquid crystal or the like depending on the data C, E or S.

When the terminal issues no request, the copying machine A automatically checks the states of the copying machine and transmits the information to the broad area. When a fuser device is at a predetermined temperature, the transmission flag is reset and the speech synthesizer 19 instead of the oscillator 22 is activated (step 11). A data WP is set and a phrase data of "COPY OK" is read out of the ROM 20 to broadcast it by the speech sound. If the copying machine is in the trouble mode, a destination Y and the data E are set to inform the service center (steps 12 and 13). In response to the data E, the service center calls a service man and increments a trouble counter. If the copying machine is in the copy mode, a destination data Z and the data C are set for the destination shown in FIG. 4 or 6 (steps 14 and 15). The transmission flag is checked (step 16) and the speech output is produced (step 17) and the data is transmitted (step 9).

Figure 7:
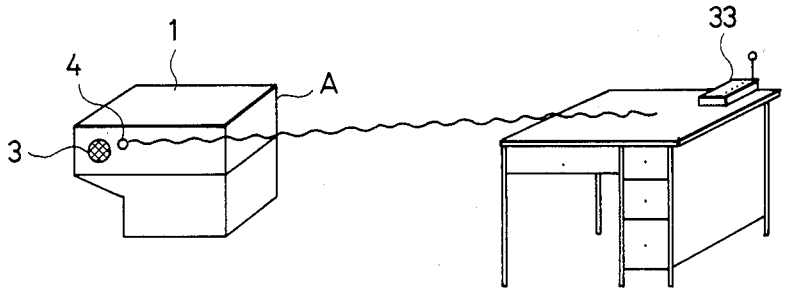
FIG. 7 shows an embodiment of bilateral information transmission.
Figure 8:
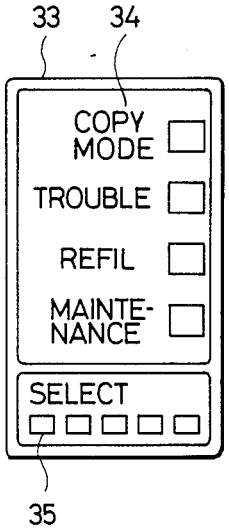
FIG. 8 is a plan view of a control panel of an external equipment.

FIG. 7 shows an embodiment in which information is bilaterally transmitted between the copying machine A and an external equipment 33. The external equipment 33 is mounted on a desk and a control panel thereof has a display screen as shown in FIG. 8. The control panel of the external equipment 33 comprises a display 34 which displays COPY MODE, TROUBLE, REFIL and MAINTENANCE, and signal select keys 35 for requesting replies.

If an inquiry of copy mode is made by the select key 35, it is transmitted from the external equipment (e.g. 29) having the high frequency oscillator 27 and the microphone 4' to the copying machine. On the other hand, the copying machine receives the signal by the microphone 4 and the microprocessor 17 determines the state by the digital code from the demodulator 24. The discriminated state is transmitted through the high frequency oscillator 22, the audio modulator 23 and the microphone 4. The external equipment 33 receives the signal and turns on the display.

The display 34 and the signal select keys 35 are not limited to the illustrated embodiment but they may include various remotely controllable command items such as power up/down of the copying machine. When the microprocessor 17 executes the control corresponding to the command it is desirable that the equipment 33 receives the confirmation signal and informs it by turning on the display.

The external equipment 33 may be a handy family computer. In this case, alphabetic keys may be used as the select keys 35 to send the inquiry (reply request) to the copying machine A.

When the host unit A is a word processor or a family computer, the wait-up time corresponds to a program load time from a floppy disc and the copy mode corresponds to a word processing mode and a print mode. Those modes are discriminated and the corresponding information is transmitted to a distant place. By discriminating the word processing mode and the print mode, the user can conveniently utilize the system.

As described hereinabove, according to the present invention, the information is transmitted from the image forming apparatus to the external equipment by a high frequency signal in the non-audio range. Thus, the user at the distant place can be informed of the operation states of the apparatus such as the end of the wait time, the end of the continuous copy operation, the request for the supplement of the papers during the continuous copy operation and the abnormal condition such as jam without troubling the other persons in the office. The user can also effectively utilize the idle time in the copy operation.

According to one aspect of the present invention, the information is transmitted by a high frequency signal in the non-audio range or by an audio frequency signal. Accordingly, the combination of the restricted information and the non-restricted information is possible. By such a combination, the information can be actively exchanged while keeping the office quiet and the efficiency and the manageability of the image forming apparatus are improved.

What I claim is:

1. An image forming system comprising:

an image forming apparatus;

a plurality of signal generating devices for generating respective inquiry signals to said image forming apparatus, while said apparatus is supplied with power, wherein the respective inquiry signals are for inquiring as to the states of said apparatus;

means for receiving the respective inquiry signals from each of said plurality of signal generating devices;

means for recognizing which one of said signal generating devices has generated a respective inquiry signal received by said receiving means; and means for transmitting an answer signal, responsive to the respective inquiry signal received by said receiving means, to said one of said signal generating devices recognized by said recognizing means, the answer signal indicating the states of said apparatus, wherein each of said signal generating devices includes means for receiving an answer signal and means for informing an operator of the states of said apparatus in response to the answer signal.

2. An image forming system according to claim 1, wherein said plurality of signal generating means generate respective inquiry signals having respective frequencies.

3. An image forming system according to claim 2, wherein said recognizing means detects the frequency of the inquiry signal received by said receiving means.

4. An image forming system according to claim 1, wherein said transmitting means varies the frequency of the answer signal in response to an output from said recognizing means.

* * * * *